US009238362B2

(12) United States Patent
Uda et al.

(10) Patent No.: US 9,238,362 B2
(45) Date of Patent: Jan. 19, 2016

(54) INKJET PRINTING APPARATUS

(71) Applicant: DAINIPPON SCREEN MFG. CO., LTD, Kyoto-shi, Kyoto (JP)

(72) Inventors: Takahiro Uda, Kyoto (JP); Kunio Muraji, Kyoto (JP); Yoshiyuki Nishigaito, Kyoto (JP)

(73) Assignees: RICOH COMPANY, LTD., Tokyo (JP); Screen Holdings Co., Ltd., Kyoto (JP)

( * ) Notice: Subject to any disclaimer, the term of this patent is extended or adjusted under 35 U.S.C. 154(b) by 0 days.

(21) Appl. No.: 14/362,576

(22) PCT Filed: Jan. 15, 2013

(86) PCT No.: PCT/JP2013/000131

§ 371 (c)(1),
(2) Date: Jun. 3, 2014

(87) PCT Pub. No.: WO2013/114790

PCT Pub. Date: Aug. 8, 2013

(65) Prior Publication Data

US 2014/0333700 A1 Nov. 13, 2014

(30) Foreign Application Priority Data

Feb. 3, 2012 (JP) ..... 2012-022067

(51) Int. Cl.
*B41J 2/16* (2006.01)
*B41J 2/045* (2006.01)
(Continued)

(52) U.S. Cl.
CPC ..... *B41J 2/04548* (2013.01); *B41J 2/0451* (2013.01); *B41J 2/04541* (2013.01);
(Continued)

(58) Field of Classification Search
CPC .. B41J 2/04548; B41J 2/0451; B41J 2/04541; B41J 2/04586; B41J 2/14; B41J 29/38; B41J 29/393; B41J 2002/144
USPC ..... 347/50, 57–59, 5, 12, 14
See application file for complete search history.

(56) References Cited

U.S. PATENT DOCUMENTS 8,403,447 B1 * 3/2013 Gardner et al. ..... 347/14
2002/0051024 A1 * 5/2002 Naoi ..... 347/13
2013/0342968 A1 * 12/2013 Peterson et al. ..... 361/622

FOREIGN PATENT DOCUMENTS

JP 09-288531 * 11/1977 ..... G06F 1/26
JP 09-288531 A 11/1997
(Continued)

OTHER PUBLICATIONS

International Search Report issued in International Application No. PCT/JP2013/000131 with Date of mailing Apr. 9, 2013, with English Abstract.

*Primary Examiner* — Henok Legesse
(74) *Attorney, Agent, or Firm* — McDermott Will & Emery LLP

(57) ABSTRACT

When one of first to third power supply circuits breaks down, a change-over switch performs switching of electrical connection such that drive voltage is allowed to be supplied from normal one of the first to third power supply circuits also to one of the inkjet heads connected to the breakdown power supply circuit. Consequently, the power supply circuits are partially sharable with a plurality of inkjet heads, causing no necessity of stopping the apparatus for replacing one breakdown power supply circuit. As a result, suppression in decrease of throughput of the apparatus is obtainable.

11 Claims, 5 Drawing Sheets

(51) Int. Cl.

| | |
|---|---|
| ***B41J 29/38*** | (2006.01) |
| ***B41J 2/14*** | (2006.01) |
| ***B41J 29/393*** | (2006.01) |

(52) U.S. Cl.

CPC ..... *B41J2/04586* (2013.01); *B41J 2/14* (2013.01); *B41J 29/38* (2013.01); *B41J 29/393* (2013.01); *B41J 2002/14491* (2013.01)

(56) References Cited

FOREIGN PATENT DOCUMENTS

| | | | | | |
|---|---|---|---|---|---|
| JP | 11-192695 | A | | 7/1999 | |
| JP | 2008-228187 | | * | 9/2008 | ..... H04N 1/00 |
| JP | 2008-228187 | A | | 9/2008 | |
| JP | 2009-285998 | A | | 12/2009 | |

* cited by examiner

INKJET PRINTING APPARATUS

CROSS REFERENCE TO RELATED APPLICATIONS

This application is the U.S. National Phase under 35 U.S.C. §371, of International Application No. PCT/JP2013/000131 filed on Jan. 15, 2013, which in turn claims the benefit of Japanese Application No. 2012-022067, filed on Feb. 3, 2012, the disclosures of which Applications are incorporated by reference herein.

TECHNICAL FIELD

The present invention relates to an inkjet printing apparatus configured to perform printing to a printing sheet through discharging ink droplets from inkjet heads. More particularly, the present invention is directed to a technique of supplying voltage to the inkjet heads.

BACKGROUND ART

Examples of such a conventional apparatus include one with a plurality of inkjet heads configured to discharge ink droplets, and a plurality of power supply circuits configured to supply voltage for driving the inkjet heads respectively. See, for example, Japanese Patent Publication No. 2009-285998A (FIG. 6). Specifically, each of the inkjet heads is connected to any one of the power supply circuits, and receives the voltage from only the connected power supply circuit.

PATENT LITERATURE

Japanese Patent Publication No. 2009-285998A (FIG. 6)

SUMMARY

Technical Problem

However, the example of the conventional apparatus with such a construction has the following problem. Specifically, in the conventional apparatus, each of the inkjet heads receives the voltage from only one of a plurality of power supply circuits. Accordingly, when one of the power supply circuits breaks down, an inkjet head connected to the breakdown power supply circuit cannot discharge ink droplets. Such a situation leads to necessity to stop printing by the inkjet printing apparatus until the power supply circuit is replaced. Accordingly, this situation causes reduced throughput due to breakdown in the power supply circuit. Such a problem may arise.

The present invention has been made regarding the state of the art noted above, and its one object is to provide an inkjet printing apparatus that allows switching of power supply circuits such that the power supply circuits are sharable partially to attain suppressed throughput due to breakdown in the power supply circuits.

Solution to Problem

The present invention is constituted as stated below to achieve the above object. One aspect of the present invention discloses an inkjet printing apparatus for performing printing to a printing sheet through discharging ink droplets. The apparatus includes at least three inkjet heads capable of discharging the ink droplets to the printing sheet simultaneously in response to inputted electric signals and arranged orthogonal to a transport direction of the printing sheet; at least three power supply circuits configured to supply drive voltage to the inkjet heads respectively; and a change-over switch disposed between the inkjet heads and the power supply circuits and electrically connecting the power supply circuits to the inkjet heads respectively. When one of the power supply circuits breaks down, the change-over switch performs switching of electrical connection such that the drive voltage is allowed to be supplied to the inkjet heads by electrically connecting the power supply circuits other than the breakdown power supply circuit to one of the inkjet heads corresponding to the breakdown power supply circuit.

Operation and Effect

With the aspect of the present invention, when one of the power supply circuits breaks down, the change-over switch performs switching so as to electrically connect the power supply circuits other than the breakdown power supply circuit to one of the inkjet heads corresponding to the breakdown supply circuit. Consequently, power can be supplied from all the power supply circuits other than the breakdown power supply circuit to one of the inkjet heads corresponding to the breakdown power supply circuit, causing no necessity of stopping the apparatus for replacing one breakdown power supply circuit. As a result, suppression in decrease of throughput of the apparatus is obtainable.

Moreover, in the aspect of the present invention, the change-over switch electrically connects the power supply circuits and the inkjet heads in one-to-one manner, and when one of the power supply circuits breaks down, electrically connects all the power supply circuits other than the breakdown power supply circuit to one of the inkjet heads corresponding to the breakdown power supply circuit. Such is preferable.

Moreover, the aspect of the present invention further includes a power-source monitoring circuit configured to monitor abnormal operation of each of the power supply circuits; and a controller configured to control the change-over switch so as to disconnect the breakdown power supply circuit from the corresponding inkjet head when the power-source monitoring circuits detects breakdown in one of the power supply circuits, thereby electrically connecting the power supply circuits the other of the breakdown power supply circuit to the inkjet head corresponding to the breakdown power supply circuit. Such is preferable.

The power-source monitoring circuit monitors the abnormal operation of each of the power supply circuits. This ensures to detect breakdown in any of the power supply circuits. The controller controls the change-over switch in response to the result, ensuring to switch the drive voltage.

Moreover, the aspect of the present invention further includes a discharge control unit configured to retard a discharging speed of the ink droplets from the inkjet head corresponding to the breakdown power supply circuit and the inkjet heads other than the corresponding inkjet head when one of the power supply circuits breaks down. Such is preferable.

The power supply circuits decrease in number, possibly causing excess power capacities of the power supply circuits. Accordingly, continued normal operation may lead to unstable operation. Here, the discharge control unit retards the discharging speed of the ink droplets, thereby achieving continuous operation within the power capacities of the power supply circuit. Consequently, stable printing is continuously performable even at a reduced printing speed.

Moreover, the aspect of the present invention further includes a movement control circuit configured to retard a relative moving speed between the printing sheet and each of the inkjet heads when one of the power supply circuits breaks down. Such is preferable.

The power supply circuits decrease in number, possibly causing excess power capacities of the power supply circuits. Accordingly, continued normal operation may lead to unstable operation. Here, the movement control circuit retards the relative moving speed, and thus discharge of the ink droplets from the inkjet heads also gets slow. This achieves continuous operation within the power capacities of the power supply circuits. Consequently, stable printing is continuously performable even at a reduced printing speed.

Moreover, in the aspect of the present invention, when the apparatus actuates again after one of the power supply circuits breaks down, the change-over switch electrically connects the power supply circuits other than the breakdown power supply circuit to one of the inkjet heads corresponding to the breakdown power supply circuit, thereby switching the power supply circuits and the inkjet heads into an electrically connected state respectively. Such is preferable.

When one power supply circuit breaks down, the change-over switch operates and thereafter printing is continuously performed. Then the apparatus stops at timing with no obstruction to the printing. Thereafter, the breakdown power supply circuit is replaced with new one, and the apparatus actuates again. At this time, the change-over switch electrically connects the power supply circuits and the inkjet heads in a one-to-one manner. This achieves preparation for abnormality of one of the power supply circuits immediately after the apparatus actuates again.

Advantageous Effects of Invention

In the inkjet printing apparatus of the present invention, when one of the power supply circuits breaks down, the change-over switch perform is switching of electrical connection such that the drive voltage is allowed to be supplied from the other of the power supply circuits also to one of the inkjet heads. Consequently, the power supply circuits are partially sharable with a plurality of inkjet heads, causing no necessity of stopping the apparatus for replacing one breakdown power supply circuit. As a result, suppression in decrease of throughput of the apparatus is obtainable.

DESCRIPTION OF EMBODIMENTS

Figure 1:
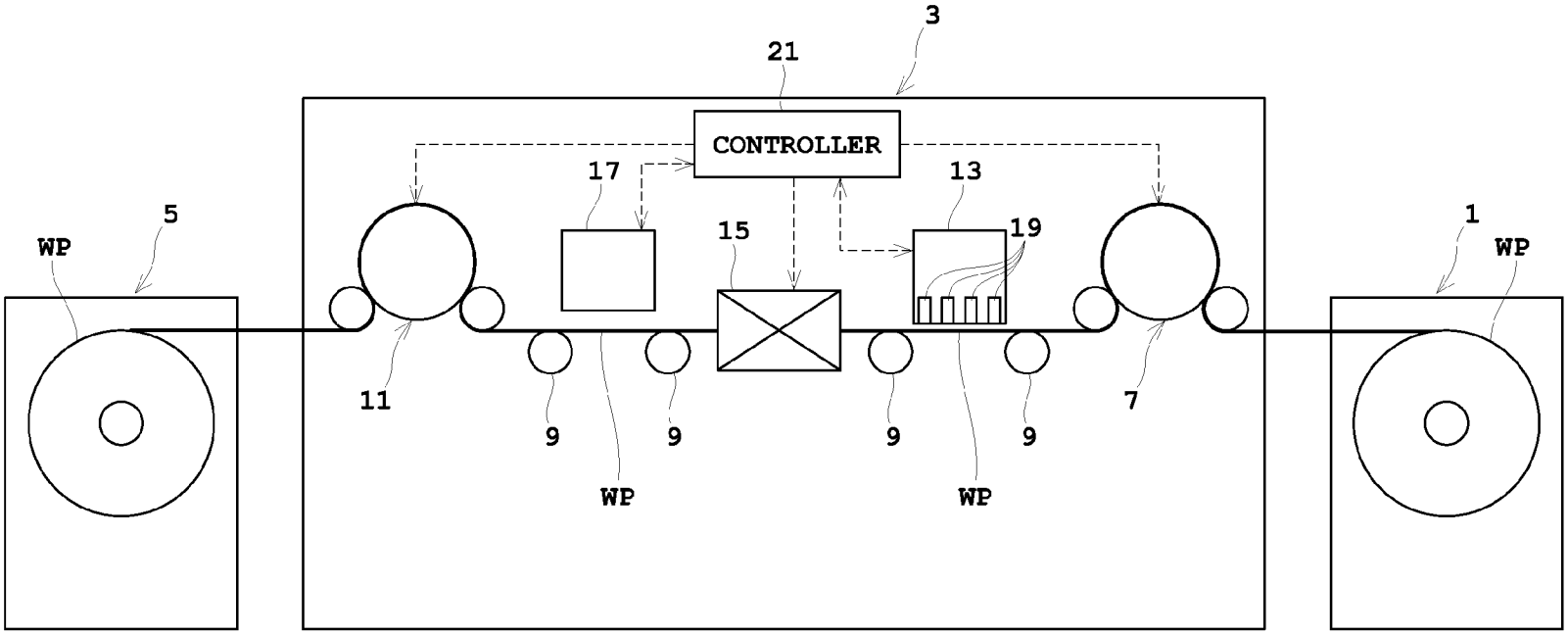
FIG. 1 is a schematic view illustrating an entire inkjet printing system according to one embodiment of the present invention.

Preferred examples of the present invention will be described in detail hereinafter with reference to the drawings. FIG. 1 is a schematic view illustrating an inkjet printing system according to one embodiment of the present invention.

The inkjet printing system according to the embodiment includes a paper feeder 1, an inkjet printing apparatus 3, and a take-up roller 5.

The paper feeder 1 holds the web paper WP in a roll form to be rotatable about a horizontal axis, and unwinds and feeds out the web paper WP to the inkjet printing apparatus 3. The inkjet printing apparatus 3 performs printing to the web paper WP. The take-up roller 5 winds up the web paper WP printed by the inkjet printing apparatus 3 about a horizontal axis. Regarding the side from which the web paper WP is fed as upstream and the side to which the web paper WP is discharged as downstream, the paper feeder 1 is disposed upstream of the inkjet printing apparatus 3 whereas the take-up roller 5 is disposed downstream of the inkjet printing apparatus 3.

The inkjet printing apparatus 3 includes a drive roller 7 in an upstream position thereof. The drive roller 7 takes the web paper WP from the paper feeder 1. The web paper WP unwound from the paper feeder 1 by the drive roller 7 is transported downstream toward the take-up roller 5 on a plurality of transport rollers 9. A drive roller 11 is disposed between the most downstream transport roller 9 and the take-up roller 5. The drive roller 11 feeds out the web paper WP travelling on the transport rollers 9 toward the take-up roller 5.

Between the drive rollers 7 and 11, the inkjet printing apparatus 3 includes a print unit 13, a drying unit 15, and an inspecting unit 17 arranged in this order from upstream to downstream. The drying unit 15 dries portions printed by the print unit 13. The inspecting unit 17 inspects the printed portions for any stains or omissions.

The print unit 13 has printing heads 19 for discharging ink droplets. The print unit 13 typically includes a plurality of printing heads being arranged in a transport direction of the web paper WP. For instance, four print units 13 are provided separately for black (K), cyan (C), magenta (M), and yellow (Y). However, in order to facilitate understanding of the invention, the following description will be given on the assumption that only one print unit 13 is provided. The print unit 13 has enough print heads 19 to perform printing without moving over a printing area in a width direction of the web paper WP (depth direction on plane of drawings). That is, the inkjet printing apparatus 3 in the embodiment performs printing on the web paper WP being fed thereto, with the print heads 19 not moving for primary scanning in a horizontal direction orthogonal to the transport direction of the web paper WP but feeding the web paper WP in a secondary scanning direction while remaining stationary. A device with such the construction is called one-pass type device.

A controller 21 controls en bloc the drive rollers 7 and 11, the print unit 13, the drying unit 15, and the inspecting unit 17. The controller 21 has a CPU, a memory or the like. The controller 21 sends image data on performing printing on the web paper WP to the print unit 13. In addition, the controller 21 controls driving speeds of the drive rollers 7 and 11 in accordance with a printing speed or the discharging speed of ink droplets in the print unit 13.

Figure 2:
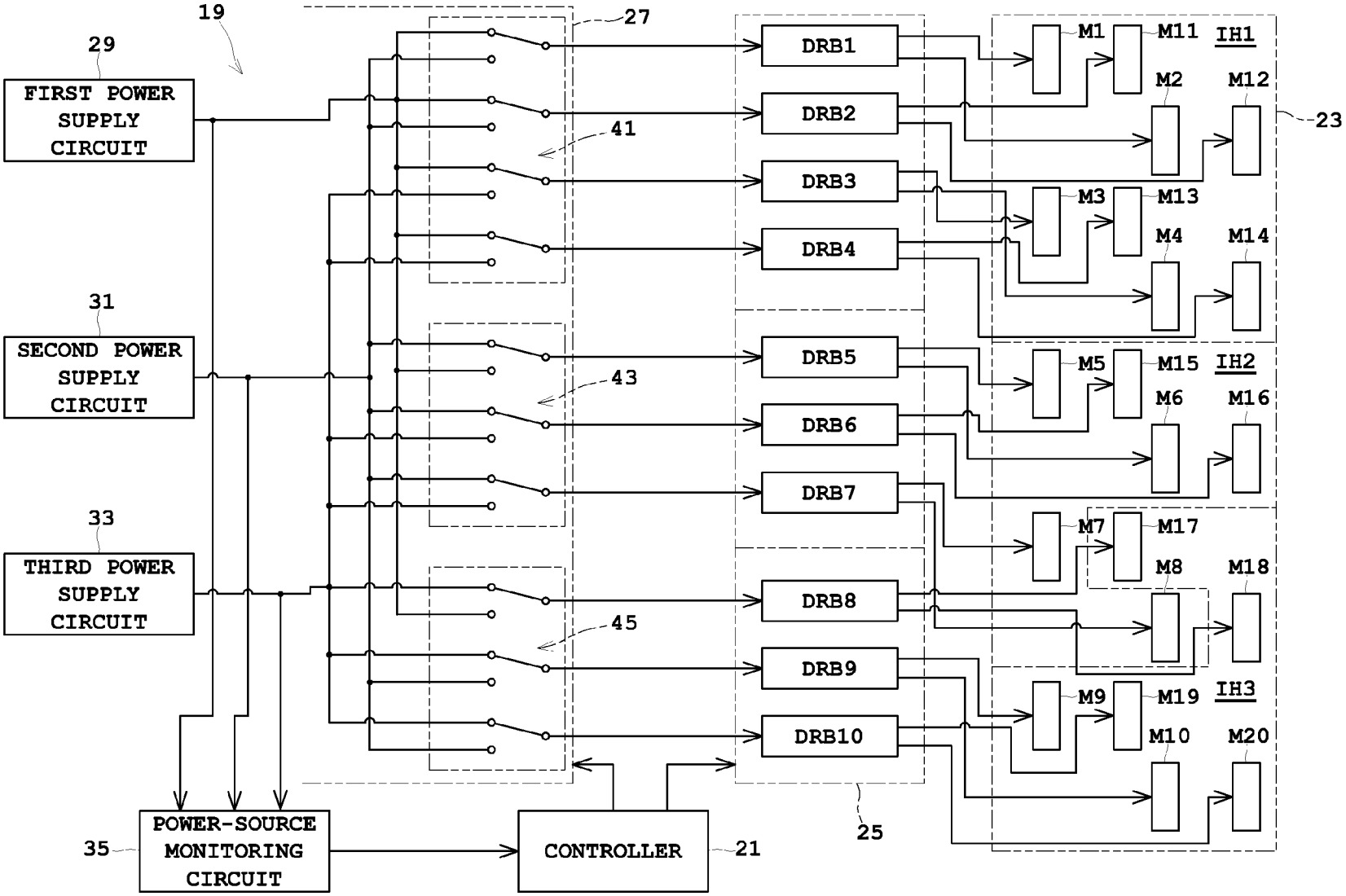
FIG. 2 is a block diagram containing peripheral circuits of a printing heads.
Figure 3:
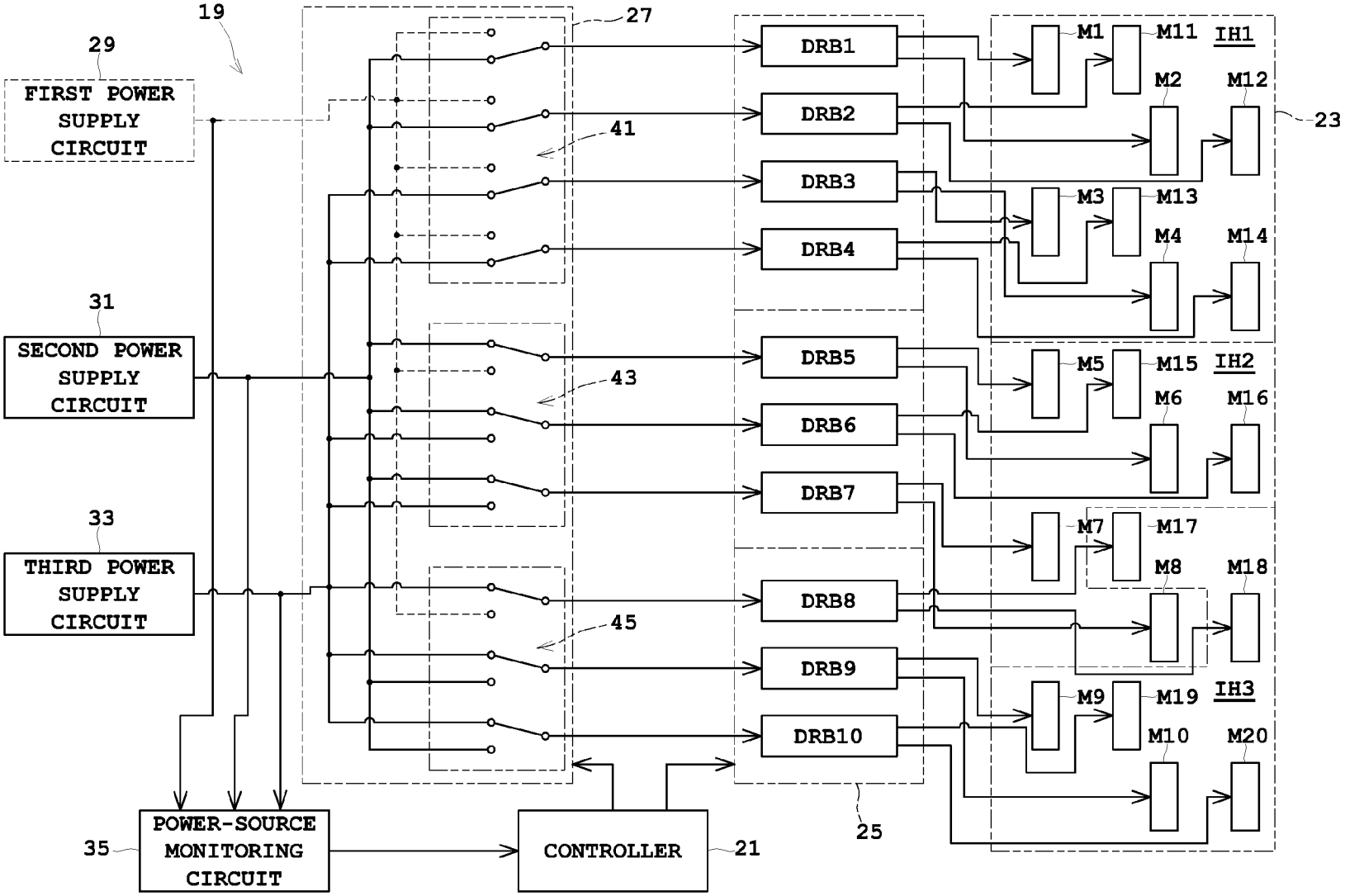
FIG. 3 is a block diagram illustrating operation when a first power supply circuit breaks down.
Figure 4:
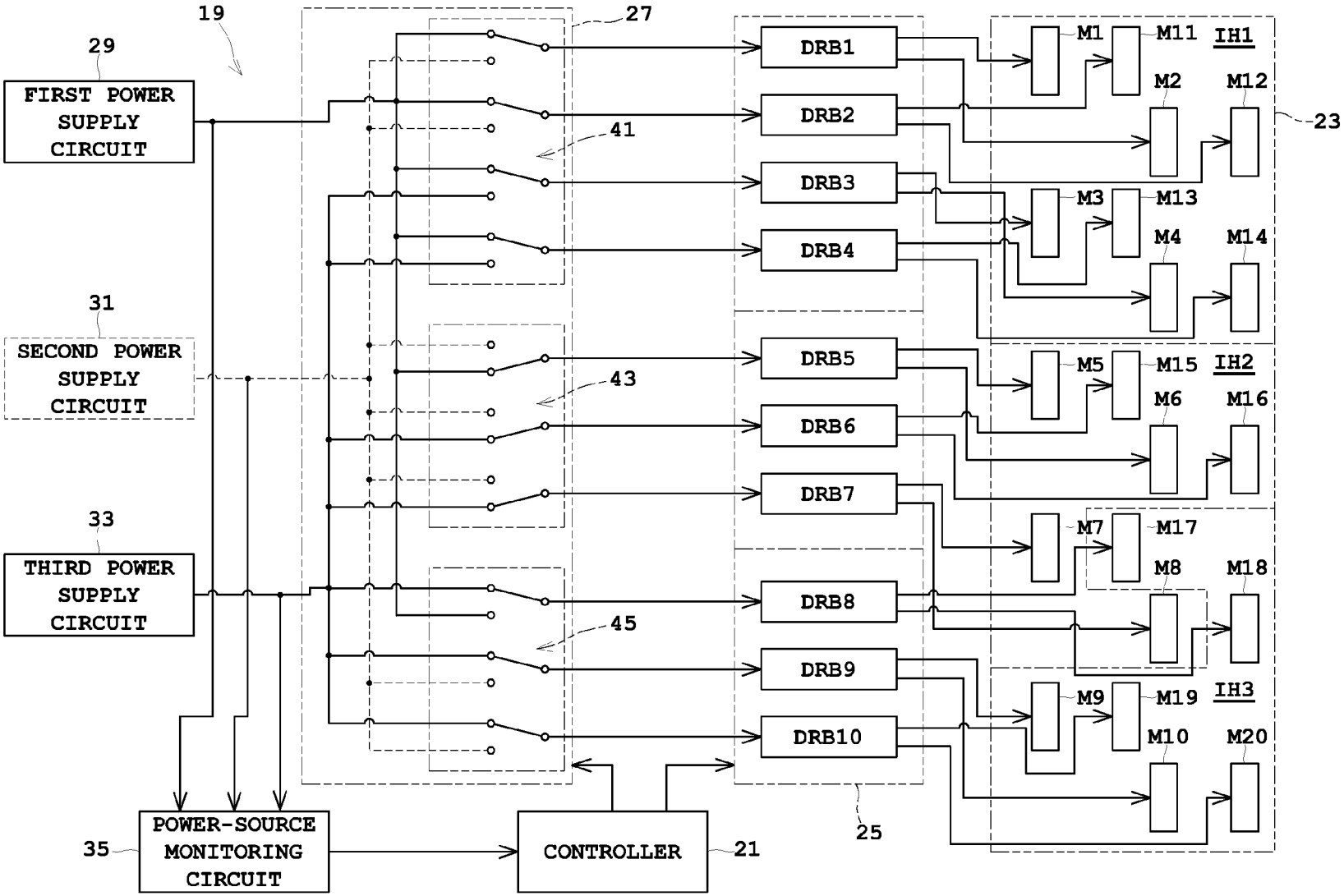
FIG. 4 is a block diagram illustrating operation when a second power supply circuit breaks down.
Figure 5:
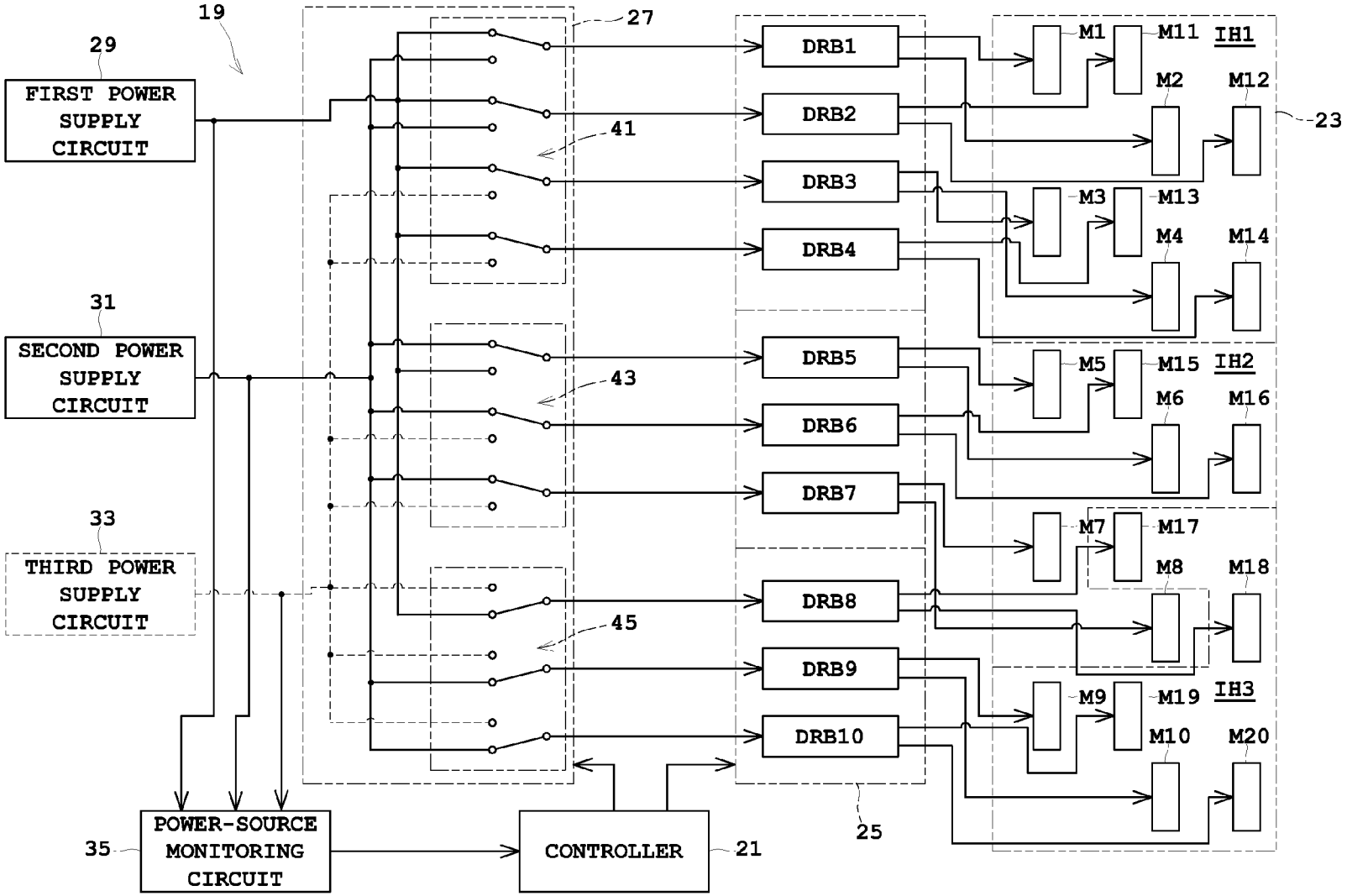
FIG. 5 is a block diagram illustrating operation when a third power supply breaks down.

Now description will be given next of the printing heads 19 with reference to FIGS. 2 to 5. FIG. 2 is a block diagram containing peripheral circuits of the printing heads. FIG. 3 is a block diagram illustrating operation when a first power supply circuit breaks down. FIG. 4 is a block diagram illustrating operation when a second power supply circuit breaks down. FIG. 5 is a block diagram illustrating operation when a third power supply circuit breaks down.

The printing head 19 includes a discharge module 23, a drive signal module 25, a change-over switch 27, a first power supply circuit 29, a second power supply circuit 31, a third power supply circuit 33, and a power-source monitoring circuit 35.

The discharge module 23 has nozzle units M1 to M20 arranged in a primary scanning direction and shifted alternately in a secondary scanning direction in a staggered manner. The nozzle units M1 to M20 each include a plurality of nozzles for discharging ink droplets. Here, the discharge module 23 is constituted by three inkjet head IH1 to IH3, the inkjet head IH1 containing the nozzle units M1 to M4, and M11 to M14, the inkjet head IH2 containing the nozzle units M5 to M8, M15 and M16, and the inkjet head IH3 containing the nozzle units M9, M10, M17 to M20.

The drive signal module 25 includes drive signal substrates DRB1 to DRB4 configured to output signals based on image data to the inkjet head IH1, drive signal substrates DRB5 to DRB7 configured to output signals based on image data to the inkjet head IH2, and drive signal substrates DRB8 to DRB10 configured to output signals based on image data to the inkjet head IH3.

The drive signal substrate DRB1 is connected to the nozzle units M1 and M2. The drive signal substrate DRB2 is connected to the nozzle units M11 and M12. The drive signal substrate DRB3 is connected to the nozzle unit M3 and M4. The drive signal substrate DRB4 is connected to the nozzle unit M13 and M14. Moreover, the drive signal substrate DRB5 is connected to the nozzle units M5 and M6. The drive signal substrate DRB6 is connected to the nozzle units M15 and M16. The drive signal substrate DRB7 is connected to the nozzle units M7 and M8. Moreover, the drive signal substrate DRB8 is connected to the nozzle units M17 and M18. The drive signal substrate DRB9 is connected to the nozzle unit M9 and M10. The drive signal substrate DRB10 is connected to the nozzle unit M19 and M20.

The first power supply circuit 29, the second power supply circuit 31, and the third power supply circuit 33 each supply voltage necessary for their operation to the drive signal module 25. Specifically, the first power supply circuit 29 supplies voltage to the drive signal substrates DRB1 to DRB4 configured to output the signals to the inkjet head IH1. The second power supply circuit 31 supplies voltage to the drive signal substrates DRB5 to DRB7 configured to output the signals to the inkjet head IH2. The third power supply circuit 33 supply voltage to the drive signal substrates DRB8 to DRB10 configured to output the signals to the inkjet head IH3.

The change-over switch 27 is disposed between the first power supply circuit 29, the second power supply circuit 31, the third power supply circuit 33 and the drive signal module 25. The change-over switch 27 includes a first change-over switch group 41, a second change-over switch group 43, and a third change-over switch group 45.

When the first power supply circuit 29 operates normally, the first change-over switch group 41 electrically connects the first power supply circuit 29 to the drive signal substrates DRB1 to DRB4 for the inkjet head IH1 (FIG. 2). In contrast to this, when only the first power supply circuit 29 operates abnormally, the first change-over switch group 41 connects the second power supply circuit 31 also to the drive signal substrates DRB1 and DRB2, and connects the third power supply circuit 33 to the drive signal substrates DRB3 and DRB4 (FIG. 3).

When the second power supply circuit 31 operates normally, the second change-over switch group 43 electrically connects the second power supply circuit 31 to the drive signal substrates DRB5 to DRB7 for the inkjet head IH2 (FIG. 2). In contrast to this, when only the second power supply circuit 31 operates abnormally, the second change-over switch group 43 connects the first power supply circuit 29 also to the drive signal substrate DRB5, and connects the third power supply circuit 33 also to the drive signal substrates DRB6 and DRB7 (FIG. 4).

When the third power supply circuit 33 operates normally, the third change-over switch group 45 electrically connects the third power supply circuit 33 to the drive signal substrates DRB8 to DRB10 for the inkjet head IH3 (FIG. 2). In contrast to this, when only the third power supply circuit 33 operates abnormally, the third change-over switch group 45 connects the first power supply circuit 29 also to the drive signal substrate DRB8, and connects the second power supply circuit 31 to the drive signal substrates DRB9 and DRB10 (FIG. 5).

The power-source monitoring circuit 35 is connected to voltage output lines of the first power supply circuit 29, the second power supply circuit 31, and the third power supply circuit 33. The power-source monitoring circuit 35 monitors a signal level of voltage and outputs information on a power supply circuit operating abnormally to the controller 21 when the voltage falls below a given signal level. Upon receiving information on the abnormal operation from the power-source monitoring circuit 35, the controller 21 stops the power supply circuit in abnormal operation and performs operation to the change-over switch 27. The operation is performed as "when abnormal operation is performed" mentioned above.

Moreover, upon "abnormal operation" due to breakdown, the controller 21 performs operation to the change-over switch 27 as mentioned above, and preferably performs further operation as under.

The controller 21 performs "discharge adjustment" to the drive signal substrates DRB1 to DRB10 for decreasing the discharging speed of ink droplets. Moreover, the controller performs "speed adjustment" for decreasing the rotation speeds of the drive rollers 7 and 11.

Here, the controller 21 corresponds to the "discharge control unit" and the "movement control circuit" in the present invention.

When "abnormal operation" mentioned above, the power supply circuits are partially shared. Accordingly, the power supply circuits may have excess power capacities. Consequently, continuous normal operation for printing may cause unstable operation. Then, the controller 21 retards the discharging speed of ink droplets, whereby the power supply circuits can be operate continuously within the power capacities. As a result, stable printing is continuously performable even at a reduced printing speed. Moreover, the controller 21 retards the relative moving speed, and thus discharge of the ink droplets from the inkjet heads also gets slow. This achieves continuous operation of the power supply circuits within the power capacities. As a result, stable printing is continuously performable even at a reduced printing speed.

Moreover, the change-over switch 27 connects the first power supply circuit 29 to only the drive signal substrates DRB1 to DRB4 for the inkjet head IH1, connects the second power supply circuit 31 to only the drive signal substrates DRB5 to DRB7 for the inkjet head IH2, and connect the third power supply circuit 33 to only the drive signal substrates DRB8 to DRB10 for the inkjet head IH3 when the apparatus actuates. In other words, the normal state in FIG. 2 is set upon actuating the apparatus.

When the power supply circuit suffers abnormalities, the change-over switch 27 operates. Thereafter, printing is continuously performed for a certain period, and the apparatus stops at timing with no obstruction to the printing. Then, the breakdown power supply circuit is replaced with new one, and the apparatus actuates. At this time, the change-over switch 27 electrically connects the first to third power supply circuits 29, 31, 33 to the inkjet heads IH1 to IH3 in a one-to-one manner. This achieves preparation for partially sharing the power supply circuits when the power supply circuit suffers abnormality immediately after the apparatus actuates.

With the embodiment mentioned above, any one of the first to third power supply circuits 29, 31, 33 breaks down, the change-over switch 27 performs switching of electrical connection such that the drive voltage is allowed to be supplied from the normal circuit of the first to third power supply circuits 29, 31, 33 to also the inkjet head connected to the breakdown power supply circuit. Consequently, the power supply circuits are partially sharable with a plurality of inkjet heads IH1 to IH3, causing no necessity of stopping the apparatus for replacing one breakdown power supply circuit. As a result, suppression in decrease of throughput of the apparatus is obtainable.

The present invention is not limited to the foregoing examples, but may be modified as follows.

(1) In the embodiment mentioned above, the inkjet printing apparatus 3 is constituted by three inkjet heads IH1 to IH3. Alternatively, two inkjet heads or four or more inkjet heads are also applicable to the present invention.

(2) In the embodiment mentioned above, the change-over switch 27 operates and thereafter the "discharge adjustment" and the "speed adjustment" are performed. The adjustments are not necessary when each of the power supply circuits has a sufficient power capacity.

(3) In the embodiment mentioned above, the change-over switch 27 is set under the state of FIG. 2 upon actuating the apparatus. Alternatively, the change-over switch 27 may remain switched due to the abnormal operation. In this case, the change-over switch 27 may be reset manually into the state of FIG. 2.

(4) In the embodiment mentioned above, the inkjet printing apparatus has been described as one example that performs printing to the web paper WP in a roll form. The present invention is, however, not limited to such the web paper WP. Alternatively, the present invention is applicable to an inkjet printing apparatus that performs printing to various types of printing sheets such as a paper sheet.

INDUSTRIAL APPLICABILITY

As noted above, the present invention is suitable for an inkjet printing apparatus that performs printing to a printing sheet by discharging ink droplets from inkjet heads.

REFERENCE SIGN LIST

1 . . . paper feeder
3 . . . inkjet printing apparatus
5 . . . take-up roller
7, 11 . . . drive roller
WP . . . web paper
13 . . . print unit
19 . . . printing head
23 . . . discharge module
25 . . . drive signal module
27 . . . change-over switch
29 . . . first power supply circuit
31 . . . second power supply circuit
33 . . . third power supply circuit
35 . . . power-source monitoring circuit
M1 to M20 . . . nozzle unit
IH1 to IH3 . . . inkjet head
DRB1 to DRB10 . . . drive signal substrate
41 . . . first change-over switch group
43 . . . second change-over switch group
45 . . . third change-over switch group

What is claimed is:

1. An inkjet printing apparatus for performing printing to a printing sheet through discharging ink droplets, the apparatus comprising:

at least three inkjet heads configured to discharge the ink droplets to the printing sheet simultaneously in response to inputted electric signals, and arranged orthogonal to a transport direction of the printing sheet;

at least three power supply circuits configured to supply drive voltage to the inkjet heads respectively; and a change-over switch disposed between the inkjet heads and the power supply circuits and electrically connecting the power supply circuits to the inkjet heads, respectively, and, when one of the power supply circuits breaks down, switching electrical connection such that the drive voltage is allowed to be supplied to the inkjet heads by electrically connecting the power supply circuits other than the breakdown power supply circuit to one of the inkjet heads corresponding to the breakdown power supply circuit, wherein when none of the power supply circuits breaks down, the change-over switch electrically connects the power supply circuits and the inkjet heads in one-to-one manner, and when one of the power supply circuits breaks down, the change-over switch electrically connects all the power supply circuits other than the breakdown power supply circuit to one of the inkjet heads corresponding to the breakdown power supply circuit.

2. The inkjet printing apparatus according to claim 1, further comprising:

a power-source monitoring circuit configured to monitor abnormal operation of each of the power supply circuits; and a controller configured to control the change-over switch so as to disconnect the breakdown power supply circuit from the corresponding inkjet head when the power-source monitoring circuits detects breakdown in one of the power supply circuits, thereby electrically connecting the power supply circuits to the other of the breakdown power supply circuit to the inkjet head corresponding to the breakdown power supply circuit.

3. The inkjet printing apparatus according to claim 2, further comprising:

a discharge control unit configured to retard a discharging speed of the ink droplets from each of the inkjet head corresponding to the breakdown power supply circuit and the inkjet heads other than the corresponding inkjet head when the one of the power supply circuits breaks down.

4. The inkjet printing apparatus according claim 2, further comprising:

a movement control circuit configured to retard a relative moving speed between the printing sheet and each of the inkjet heads when one of the power supply circuits breaks down.

5. The inkjet printing apparatus according claim 2, wherein when the apparatus actuates again after one of the power supply circuits breaks down, the change-over switch electrically connects one of the power supply circuits other than the breakdown power supply circuit to one of the inkjet heads corresponding to the breakdown power supply circuit, thereby switching the power supply circuits and the inkjet heads into an electrically connected state respectively.

6. The inkjet printing apparatus according to claim 1, further comprising:

a discharge control unit configured to retard a discharging speed of the ink droplets from the inkjet head corresponding to the breakdown power supply circuit and the inkjet heads other than the corresponding inkjet head when the one of the power supply circuits breaks down.

7. The inkjet printing apparatus according claim 6, further comprising:

a movement control circuit configured to retard a relative moving speed between the printing sheet and each of the inkjet heads when one of the power supply circuits breaks down.

8. The inkjet printing apparatus according claim 6, wherein when the apparatus actuates again after one of the power supply circuits breaks down, the change-over switch electrically connects one of the power supply circuits other than the breakdown power supply circuit to one of the inkjet heads corresponding to the breakdown power supply circuit, thereby switching the power supply circuits and the inkjet heads into an electrically connected state respectively.

9. The inkjet printing apparatus according claim 1, further comprising:

a movement control circuit configured to retard a relative moving speed between the printing sheet and each of the inkjet heads when one of the power supply circuits breaks down.

10. The inkjet printing apparatus according claim 9, wherein when the apparatus actuates again after one of the power supply circuits breaks down, the change-over switch electrically connects one of the power supply circuits other than the breakdown power supply circuit to one of the inkjet heads corresponding to the breakdown power supply circuit, thereby switching the power supply circuits and the inkjet heads into an electrically connected state respectively.

11. The inkjet printing apparatus according claim 1, wherein when the apparatus actuates again after one of the power supply circuits breaks down, the change-over switch electrically connects one of the power supply circuits other than the breakdown power supply circuit to one of the inkjet heads corresponding to the breakdown power supply circuit, thereby switching the power supply circuits and the inkjet heads into an electrically connected state respectively.

* * * * *